US007637649B2

(12) United States Patent
Garcia et al.

(10) Patent No.: US 7,637,649 B2
(45) Date of Patent: Dec. 29, 2009

(54) REVERSIBLE LAMP

(75) Inventors: Ceferino Garcia, Juarez (MX); Richard C. Laird, El Paso, TX (US)

(73) Assignee: Osram Sylvania Inc., Danvers, MA (US)

( * ) Notice: Subject to any disclaimer, the term of this patent is extended or adjusted under 35 U.S.C. 154(b) by 17 days.

(21) Appl. No.: 11/583,444

(22) Filed: Oct. 19, 2006

(65) Prior Publication Data

US 2008/0094856 A1 Apr. 24, 2008

(51) Int. Cl.
*H01R 33/00* (2006.01)
*H05B 31/00* (2006.01)

(52) U.S. Cl. ..... 362/640; 362/262; 362/651; 362/652; 362/655; 362/659

(58) Field of Classification Search ..... 362/652–658, 362/262, 651, 659, 260, 265, 640; 313/318.01–318.05
See application file for complete search history.

(56) References Cited

U.S. PATENT DOCUMENTS

| | | | | |
|---|---|---|---|---|
| 4,899,266 | A | 2/1990 | Ahroni | |
| 5,313,134 | A * | 5/1994 | Borgis et al. | 313/318.01 |
| 6,607,293 | B2 * | 8/2003 | Suzuki et al. | 362/430 |

* cited by examiner

*Primary Examiner*—Sharon E Payne
*Assistant Examiner*—Sean P Gramling
(74) *Attorney, Agent, or Firm*—William H. McNeill

(57) ABSTRACT

A lamp (160) comprising: a light-emitting lamp capsule (161) arrayed about a longitudinal axis (161*a*); a base (162) supporting said lamp capsule (161), said base (162) including a peripheral flange (163) extending normal to said longitudinal axis 161*a*); and electrical contacts (164) attached to said peripheral flange for providing power to said light-emitting lamp capsule (161), said electrical contacts (164) extending from said peripheral flange (163) in a direction parallel to said longitudinal axis (161*a*).

6 Claims, 2 Drawing Sheets

REVERSIBLE LAMP

CROSS-REFERENCE TO RELATED APPLICATION

This application is a filing under 37 CFR 1.114 of application Ser. No. 11/583,444, filed Oct. 19, 2006 and priority is claimed from the filing date of the parent application.

TECHNICAL FIELD

This invention relates to lamps sand more particularly to lamps that can load from a front or rear loading position.

BACKGROUND ART

Lamp fixture manufacturers design fixtures for high power lamps to accept lamps from either a front or rear position. Such designs require a number of different lamps and a number of different sockets. Naturally, this requires manufacturers to keep an inventory of multiple lamps and sockets; an expensive and cumbersome approach to fixture design. It would, therefore, be an advance in the art if a lamp having multiple configurations could be provided that could load from either a forward loading or rear loading fixture.

DISCLOSURE OF INVENTION

It is, therefore, an object of the invention to obviate the disadvantages of the prior art.

It is another object of the invention to enhance lamp sockets.

Yet another object of the invention is the provision of a lamp socket that can accept multiple lamps from a variety of positions.

These object are accomplished, in one aspect of the invention, by a lamp comprising: a light-emitting lamp capsule arrayed about a longitudinal axis; a base 162 supporting said lamp capsule, said base including a peripheral flange extending normal to said longitudinal axis, and electrical contacts attached to said peripheral flange for providing power to said light-emitting lamp capsule, said electrical contacts extending from said peripheral flange in a direction parallel to said longitudinal axis.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
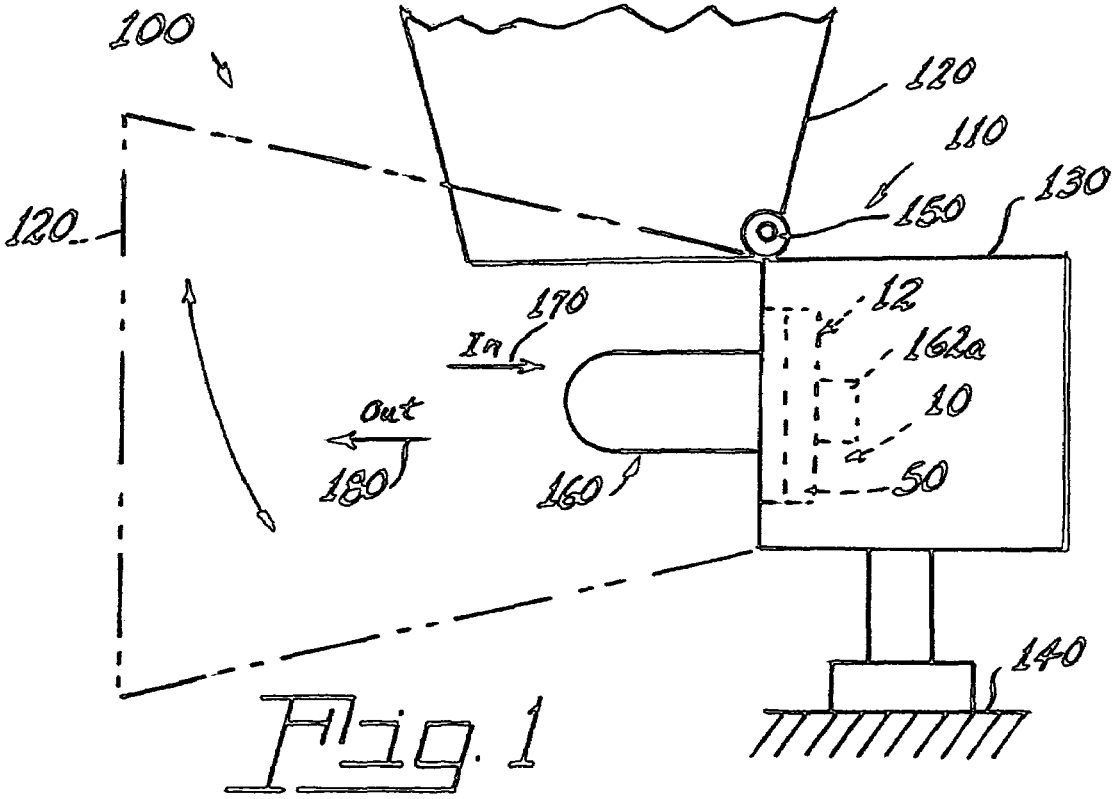
FIG. 1 is a diagrammatic view of a front-loading fixture.

Referring now to the drawings with greater particularity, there is shown in FIG. 1 a front-loading fixture 100 having a housing 110 that includes a front portion 120 and a rear portion 130. The rear portion 130 can be fixed to a support 140 and the front portion 120 can be opened via a hinge 150 to gain access to a lamp 160 that is inserted into a socket 10. The lamp 160 is inserted and removed from the socket 10 in the directions indicated by the arrows 170, 180.

Figure 2:
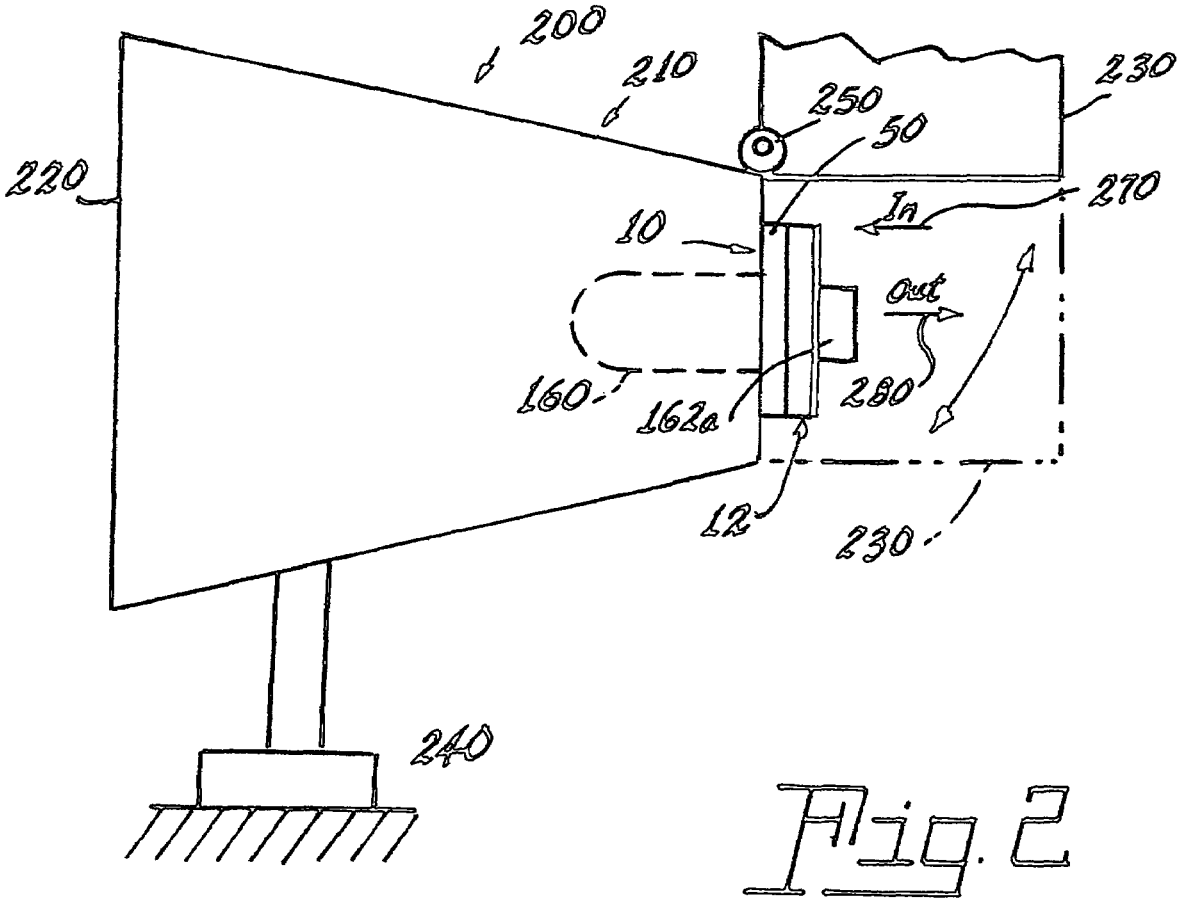
FIG. 2 is a diagrammatic view of a rear-loading fixture.

A rear-loading fixture 200 is depicted in FIG. 2 wherein the fixture 200 has a housing 210 with a front portion 220 and a rear portion 230. In this instance it is the front portion 220 that is fixed to a support 240 and the rear portion 230 that can be opened via a hinge 250 to gain access to a lamp 160 that is inserted into socket 10. The lamp 160 for fixture 200 is inserted and removed from the rear as indicated by the arrows 270, 280.

Figures 3, 4, 5:
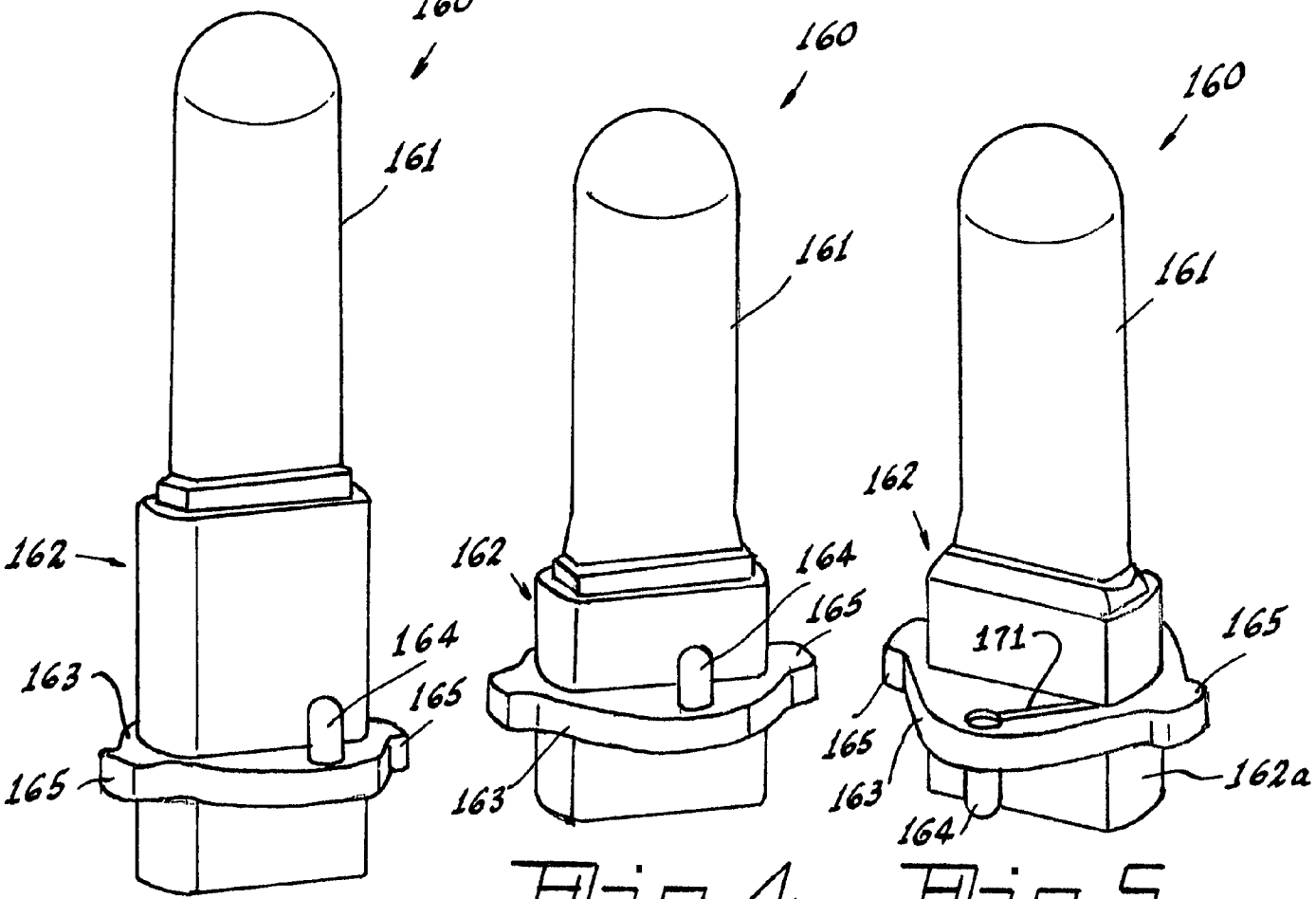
FIGS. 3-5 are perspective views of lamps illustrating embodiments of the invention.

Referring to FIGS. 3-5, lamps 160 capable of accomplishing this desirable result comprise a lamp capsule 161 having a reversible base 162 of a suitable material, such as a high temperature ceramic or plastic. The base 162 includes a flange 163 with a pair of lamp contacts 164 oppositely disposed thereon and projecting therefrom. Lamp retainers 165 are formed with the flange 163 and are orthogonal to the lamp contacts 164. The bases 162 can have a long body, as is shown in FIG. 3 or a short body, as shown in FIGS. 4 and 5 to accommodate various types of light-emitting lamp capsules 161 such as tungsten halogen capsules, arc discharge capsules or capsules containing other types of light emitters. The capsules can be of varying lengths to provide different focal points.

The lamps 160, shown in FIGS. 3 and 4, have the lamp contacts 164, in the form of cylindrical prongs 164*a* and 164*b*, facing forward, that is, towards the lamp capsule, and these lamps are used with fixtures 200, where the lamps are inserted from the rear of the fixture.

The lamp 160, shown in FIG. 5, has the lamp contacts 164 facing rearward, that is, away from the lamp capsule and these lamps are employed with fixtures 100, where the lamp would be inserted from the front of the fixture.

Electrical connection from the lamp lead-ins can be provided via trenches 171 set into the flange 163, one of which is illustrated in FIG. 5.

While there have been shown what are at present considered to be the preferred embodiments of the invention, it will be apparent to those skilled in the art that various changes and modifications can be made herein without departing from the scope of the invention as defined by the appended claims.

The invention claimed is:

1. A lamp comprising:

a light-emitting lamp capsule having a given diameter arrayed about a longitudinal axis;

a reversible base supporting said lamp capsule, said base including a peripheral flange extending normal to said longitudinal axis and having a diameter larger than said given diameter; and electrical contacts in the form of cylindrical prongs attached to said peripheral flange for providing power to said light-emitting lamp capsule, said electrical contacts extending from said peripheral flange in a direction parallel to said longitudinal axis and being positioned on a diameter larger than said given diameter whereby said light-emitting lamp supported by said reversible base can be adapted for use with front or rear loading fixtures.

2. The lamp of claim 1 wherein said peripheral flange has a forward surface facing said light-emitting lamp capsule and said electrical contacts are positioned on said forward surface and extend toward said light-emitting lamp capsule.

3. The lamp of claim 1 wherein said peripheral flange has a rear surface facing away from said light-emitting lamp capsule and said electrical contacts are positioned on said rear surface and extend away from said light-emitting lamp capsule.

4. The lamp of claim 1 wherein said peripheral flange includes lamp retainers.

5. The lamp of claim 4 wherein said lamp retainers are orthogonal to said lamp contacts.

6. A lamp comprising:

a reversible base, said base having oppositely disposed first and second surfaces;

a first lamp receiving body projecting from said first surface and a second lamp receiving body projecting from said second surface and a light-emitting lamp capsule having a given diameter arrayed about a longitudinal axis fitted into and projecting from one of said first or second lamp receiving bodies;

said base including a peripheral flange extending normal to said longitudinal axis and having a diameter larger than said given diameter; and electrical contacts in the form of cylindrical prongs attached to said peripheral flange for providing power to said light-emitting lamp capsule, said electrical contacts extending from said peripheral flange in a direction parallel to said longitudinal axis and being positioned on a diameter larger than said given diameter, whereby said light-emitting lamp can be adapted for use with front or rear loading fixtures.

* * * * *